US005365681A

United States Patent [19]

Miranda

[11] Patent Number: 5,365,681

[45] Date of Patent: Nov. 22, 1994

[54] VEHICLE FOR REMOVING SNOW ACCUMULATED ON ROADS

[76] Inventor: Frederick Miranda, Ameghino 1049, Avellaneda, (1870) Buenos Aires, Argentina

[21] Appl. No.: 907

[22] Filed: Jan. 6, 1993

Related U.S. Application Data

[63] Continuation of Ser. No. 710,513, Jun. 3, 1991, abandoned.

[30] Foreign Application Priority Data

Mar. 18, 1991 [AR] Argentina ..... 319.241

[51] Int. Cl.[5] ..... E01H 5/10

[52] U.S. Cl. ..... 37/227; 37/237; 37/199

[58] Field of Search ..... 37/227, 228, 237, 263, 37/199, 208, 219; 198/308.1, 311, 313, 316.1, 952

[56] References Cited

U.S. PATENT DOCUMENTS

| | | | |
|---|---|---|---|
| 593,980 | 11/1897 | Bullis . | |
| 1,398,042 | 11/1921 | Pullar . | |
| 1,497,432 | 6/1924 | Dolan . | |
| 1,746,417 | 2/1930 | Churl . | |
| 1,841,245 | 1/1932 | Hagen | 37/227 X |
| 1,895,900 | 1/1933 | Smith | 37/227 |
| 2,178,400 | 10/1939 | Marino | 37/228 |
| 2,642,679 | 6/1953 | Zamboni . | |
| 2,738,786 | 3/1956 | Leary | 37/227 X |
| 2,763,939 | 9/1956 | Zamboni . | |
| 3,011,273 | 12/1961 | Stumpf . | |
| 3,044,193 | 7/1962 | Zamboni . | |
| 3,098,478 | 7/1963 | Philbrook | 37/227 X |
| 3,333,354 | 8/1967 | Kirschenblat . | |
| 3,484,961 | 12/1969 | Coslowsky | 37/227 |
| 3,622,205 | 11/1971 | Zamboni . | |
| 3,745,700 | 7/1973 | Hahn | 37/227 X |
| 4,697,572 | 10/1987 | James et al. | 37/227 X |

*Primary Examiner*—Randolph A. Reese
*Assistant Examiner*—Spencer Warnick
*Attorney, Agent, or Firm*—Kuhn and Muller

[57] ABSTRACT

A vehicle for snow removal has a conveyor belt for transporting shovelled snow from a front end shovel up to a collection load box, above which the snow is melted by a plurality of heat sources for deposit into the collection load box. A pump recirculates melted snow water through a pair of parallel conduit pipes, which pipes are adjacent to the plurality of heat sources. As a result the recirculated water is reheated and the resulting warm water is discharged upon the front end shovel to commence the melting of the incoming, shovelled snow.

1 Claim, 1 Drawing Sheet

II
II

VEHICLE FOR REMOVING SNOW ACCUMULATED ON ROADS

This application is a continuation of application Ser. No. 07/710,513, filed Jun. 3, 1991 now abandoned.

BACKGROUND OF THE INVENTION—PRIOR ART

The snow and its consequences:

During centuries, countries suffering from snow storms during winter, have never found a system attenuating the severe consequences thereof. Snow storms paralyze cities, isolate villages, and prevent passage on routes and roads, airports are closed, etc., thus obliging millions of persons to remain at home for many days, often without any communication with outside. From the economical view-point, losses caused by said storms are tremendous, in many countries representing losses of millions of dollars.

Up to date, the only solution to this problem is municipal collection by trucks with sweeper blades, the the only result being accumulation of snow at the sides of the most important streets, leaving the remaining villages without any solution to the snow problem.

Due to the new technological object of the invention, it is possible to develop a novel and efficient system for terminating with snow accumulations. The emergency snow system of the invention is attainable by means of a specially designed vehicle. After the snow storm, this vehicle collects snow in a simple way and introduces snow in the interior thereof in the heater chamber in which snow is converted in hot water, thus leaving the street completely clean assuring the normal activy in cities, villages and airports.

SUMMARY OF THE INVENTION

The object of the invention is a vehicle for removing snow accumulations on streets and routes, the novelty of which resides in that it eliminates snow by melting it upon passing thereon, transforming such snow into water which is simultaneously kept into a tank carried by the vehicle.

Although the vehicle of the invention may be self-propelled or may be towed by another vehicle, such as a truck, its functional features are a consequence of its novel combination of constitutive elements, which comprise means which, during the forward movement, gradually soften the snow blanket by means of the release of hot water along the area of a longitudinal strip having a width corresponding to the minimum transit requirements; immediately collecting the snow, even in a semi-solid or paste-like condition, charging it on a longitudinal conveyor which is essentially permeable, such as a wire net worm belt, on which conveyor heat is applied under such conditions that, at the end of a predetermined horizontal path, all the snow collected is liquefied and deposited from the upper part into a container comprised by the load box of the vehicle; the possibility being foreseen of regulating the temperature with the forward speed and that of the longitudinal conveyor, thus obtaining a run rate during which a water consumption equivalent to the amount of snow being liquefied is produced, thus producing snow removal along extended road segments without stopping the vehicle to discharge the tank.

In order to obtain the above objects of the invention, the basic means constituting the vehicle of the present invention are comprised by: a chassis mounted on wheels, preferably self-propelled, which contains a high capacity tank which, although being opened at its upper part, has an elevated roof made of heat resistant material covering a space constituting the heating chamber, in the interior of which and above said tank, the rear and horizontal zone of a worm conveyor is located, the upper or load part thereof being placed between two parallel conduits of heat transmitting material, through which water circulates forwardly, pumped from the rear part of said tank; said assembly of conveyor and parallel conduits continuing towards the front part of the vehicle with a descending slope to reach practically the road, wherein a wide shovel charger receives said heated water which extends over said shovel between its side edges, there being, below said roof and at the sides of said two conduits, heat sources with two ends, i.e. progressively heating the water circulating through the parallel conduits and, completing the progressive thawing by melting the snow blocks which are moved rearwardly by the worm conveyor at a level higher than that of the water contained into the vehicle tank.

As an additional feature, not essential but convenient for carrying out the invention, said vehicle may carry, apart from the elements cited, a transversal sweeper blade, preferably of variable inclination, and an outlet means for exhausting the tank receiving the snow which is being melted, this latter means being from a simple cock to a hydraulic driven gate commanded from the driver's cabin.

Of course, in order to attain all the mentioned functions, conventional means are also included in the vehicle of the invention which, per se, have no inventive merit, but associated with the above-mentioned fundamental and accesory elements, complete the assembly. Among the conventional means, the following are cited: power means, such as a conventional power intake or an internal combustion engine; means generating pneumatic or hydraulic pressure for driving the elements regulating the height of the collecting shovel, a water suction pump, from the molten snow receiving tank, eventual brakes, the optional gate for closing the exhaust opening of said tank, etc.; a pair of parallel chains mounted in a worm holding the longitudinal conveyor belt, basically provided with blades perpendicular thereof, similar to buckets; a wave contention partition assembly distributed in the tank containing molten snow in order to avoid the water movement during running, etc.

Further, and also as an optional alternative, the forward edge of the collecting shovel may be formed by a band coplanar and separated thereof, with a plurality of expansion springs or any other elastic means, in order that said edge may escape each time a protuberance on the road impairs the vehicle running.

BRIEF DESCRIPTION OF THE DRAWINGS

The invention will now be described in connection with a preferred exemplary embodiment, and with reference to the accompanying drawings, in which.

In both figures, the same reference numerals correspond to the same or equivalent parts or elements constituting the embodiment selected as example.

DETAILED DESCRIPTION OF THE INVENTION

Figures 1, 2:
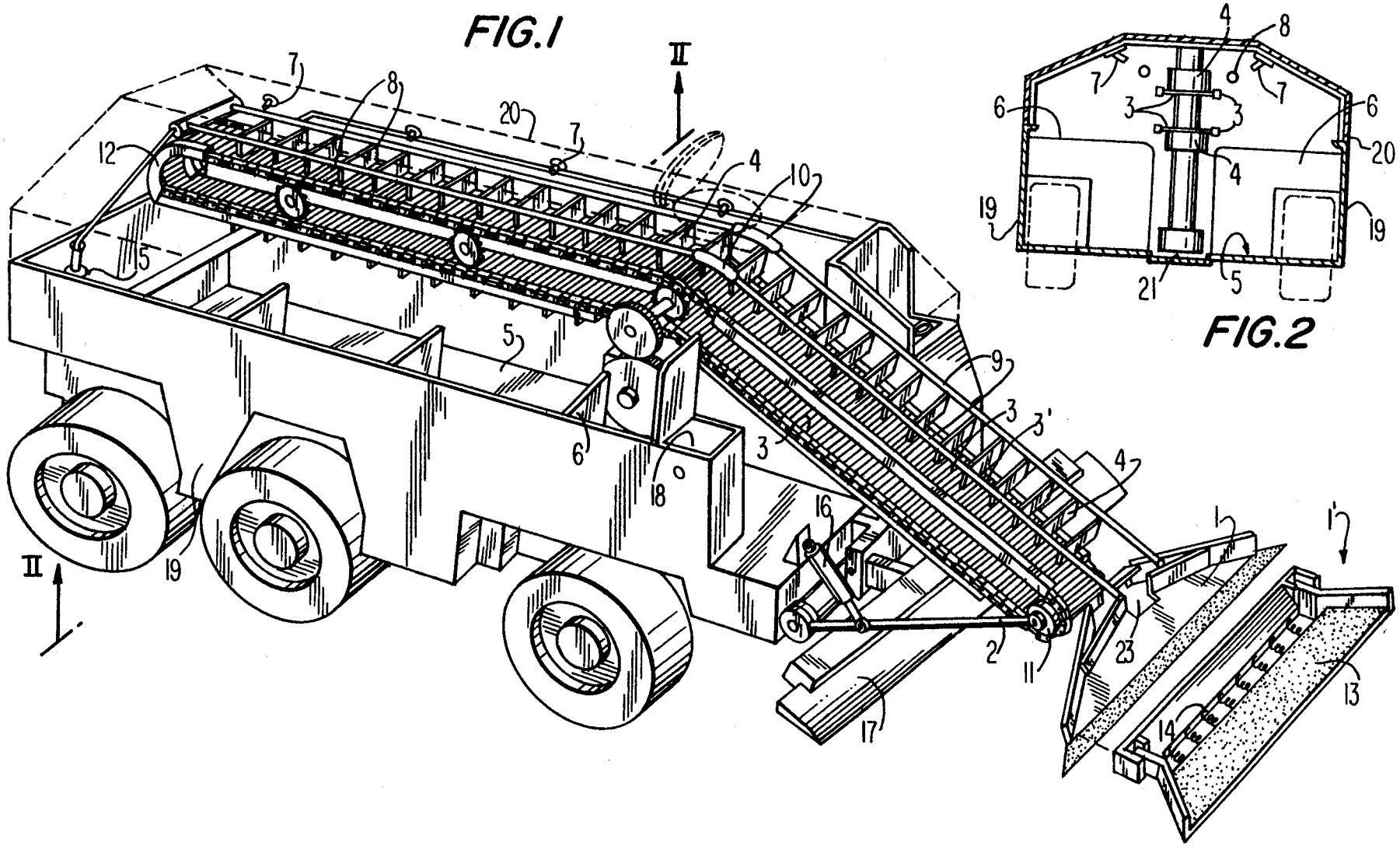
FIG. 1 is a perspective view of the assembly comprising a vehicle for removing snow accumulated on roads, including at its front part an alternative embodiment for its collecting shovel.
FIG. 2 is a cross elevational section as per line II—II indicated in FIG. 1.

As may be seen in FIG. 1, the vehicle of the invention comprises a front collecting shovel 1, for loading snow accumulated on paved routes or roads, the height of said shovel being regulated by means of side bars 2 actuated by respective pressure cylinders 16 commanded from the driver's cabin.

A longitudinal conveyor belt 3, having a forward portion ascending rearwardly and other horizontal rear portion extends from said collecting shovel to the rear end of the loading box of said vehicle; said belt being provided with blades 4 perpendicular and equidistant thereof, while said belt is constituted by a net, mesh or the like allowing passage of water or thawed snow therethrough and is held by parallel side chains 3' which may be clearly seen in FIG. 2, wherein the depth of the tank 5 receiving snow may be also seen, the snow being melted and falling between the blades 4 from the upper belt 3. In said receiving tank 5 there is a plurality of partitions or baffles 6 distributed such as to counterbalance the effect of eventual waves produced by water movements during running of the vehicle.

Said blades 4 act as snow biasing and pushing blades for the snow accumulated on the front collecting shovel 1. Although the drawing is schematic and merely illustrative, it is to be noted that the dimension of each of said blades 4, as well as the separation therebetween along their distribution on the longitudinal conveyor belt 3 affect the operation of the assembly; preferably, each blade should be 80 cm width×30 cm height, and the separation therebetween should be of about 40 cm. These figures are not to be considered as severely limitative, there being some tolerance in the dimensional variations related to the size and power of the machine.

In FIG. No. 1, a possible form for the roof cover 20 is shown in phantom, which is indicated with a solid line in FIG. No. 2. The roof cover is preferably of a material resistant to high temperatures, since adjacent said cover there are several burners 7 facing the conveyor belt in order to heat and melt snow blocks carried by the belt and also for heating water which, elevated by the pump 15 located preferably at the rear part of said tank, also circulates forwardly by parallel side conduits 8 and joins oblique descending conduits 9 parallel to the front portion of the belt 3. The heated water in conduits 9 falls to the front of the conveyor and is spread on the collecting shovel 1.

Conventional suitable means, such as wheels 11, with or without teeth, and partial guides 12 support and actuate side chains 3' for operating the mentioned longitudinal conveyor 3.

In accordance with the above, heating elements 7 may be of other nature, such as electrical and others. Of course, in each case certain precautions should be observed. However, the elements mentioned hereinabove are considered safer, efficient and economic, without limiting the invention thereto.

For clarity purposes, the vehicle chassis is not included in the drawings; the chassis should of course have the proper shape in order to support the means described and shown.

Optional alternative embodiment 1' of the collecting frontal shovel comprises a forward edge portion 13 mounted in a retractible way and counterbalanced by springs 14 thus permitting its escape in case of eventual impairment of the run due to large protuberances or obstacles on the roads.

A traversal sweeper 17 is also included at the front portion, following the collecting shovel 1, said sweeper having regulable level and slope, preferably from the driver's cabin.

Further, the optional inclusion of an anti-freeze medium or common salt reservoir, for spreading the water being accumulated in the receiving tank 5 is foreseen. It is to be noted that saline water withstands low temperatures without freezing.

An eventual fuel or gas reservoir is designated with reference 18, while with 19 side walls of said tank 5 are designated, and with reference numeral 21, an optional gate, which may be seen in FIG. No. 2, for exhausting water from the tank, being remotely commanded from the driver's cabin is indicated.

It is claimed:

1. A self-propelled motor vehicle for removing snow accumulated on roads, comprising:

a chassis mounted upon wheels and having a front and rear end; said front end of said chassis having a height adjustable collecting shovel for feeding snow collected therein onto a longitudinally extending, permeable, worm chain conveyor belt;

said conveyor belt having an upwardly slanting front end snow input portion extending from said shovel to a second horizontal rear end portion which extends above a load box on said chassis;

a plurality of heating means distributed at both sides adjacent to said horizontal rear end portion of said conveyor belt for heating and melting the snow thereon into water; the water being discharged from said horizontal rear end portion to said load box below;

a first pair of parallel water conduits extending along the horizontal rear end portion of said conveyor belt and adjacent said plurality of heating means;

a second pair of parallel water conduits in fluid communication with said first pair of parallel water conduits extending along the upwardly slanting front end snow input portion of said conveyor belt;

a pump located at said rear end of said chassis and in communication with said first pair of parallel water conduits for transferring water from said load box in a direction forwardly from said pump through said first pair of parallel water conduits to said second pair of parallel water conduits; each said conduit of said second pair having a discharge end at said shovel to discharge water onto the shovel;

wherein said plurality of heating means heat the water in said first pair of parallel water conduits to a preselected temperature for discharge upon said shovel by said discharge ends of said second pair of parallel water conduits; the discharged water preheating the snow within said shovel before the snow is transferred to said upwardly slanting front end snow input portion of said conveyor belt.

* * * * *